US010458648B2

(12) United States Patent
Chen

(10) Patent No.: US 10,458,648 B2
(45) **Date of Patent: *Oct. 29, 2019**

(54) WICK OF FLAME DEVICE

(71) Applicant: Pro-Iroda Industries, Inc., Taichung (TW)

(72) Inventor: Wei-Long Chen, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/983,199

(22) Filed: May 18, 2018

(65) Prior Publication Data

US 2018/0266677 A1 Sep. 20, 2018

Related U.S. Application Data

(63) Continuation of application No. 14/302,485, filed on Jun. 12, 2014.

(30) Foreign Application Priority Data

Sep. 5, 2013 (TW) ..... 102131977 A

(51) Int. Cl.

| | |
|---|---|
| ***F23D 3/08*** | (2006.01) |
| ***F23D 3/18*** | (2006.01) |
| *F23D 3/24* | (2006.01) |

(52) U.S. Cl.

CPC ..... *F23D 3/18* (2013.01); *F23D 3/08* (2013.01)

(58) Field of Classification Search

CPC ..... F23C 3/08; F23D 3/08; F23D 3/18

USPC ..... 431/325, 302, 195, 329; 165/104.26; 119/660

See application file for complete search history.

(56) References Cited

U.S. PATENT DOCUMENTS

| | | | | |
|---|---|---|---|---|
| 1,424,149 A | | 8/1922 | Brennan | |
| 1,481,608 A | | 1/1924 | Howard | |
| 2,375,211 A | | 5/1945 | Brennan | |
| 2,758,460 A | * | 8/1956 | Ciano | F23D 3/00 431/206 |
| 2,879,979 A | | 3/1959 | Wheeler | |
| 3,076,436 A | | 2/1963 | Newsome | |
| 3,162,030 A | * | 12/1964 | Irving | F23D 3/00 431/126 |
| 3,878,594 A | | 4/1975 | Minor, Jr. | |
| 4,375,505 A | | 3/1983 | Newkirk | |

(Continued)

FOREIGN PATENT DOCUMENTS

| | | |
|---|---|---|
| CH | 292239 A | 7/1953 |
| FR | 2287501 A1 | 5/1976 |

(Continued)

*Primary Examiner* — Steven B McAllister
*Assistant Examiner* — Desmond C Peyton
(74) *Attorney, Agent, or Firm* — Alan D. Kamrath; Karin L. Williams; Mayer & Williams PC

(57) ABSTRACT

A wick configured from a single metallic meshed wick material continuously includes a spiral section with a shape including at least one loop, and a folded section with a shape including a fold. A first length extends away from the spiral section to the fold and along a first imaginary plane, and a second length extends from the fold to the spiral section and along a second imaginary plane. A wrapped section has a shape including at least one contour conforming shapes of the spiral and folded sections.

12 Claims, 18 Drawing Sheets

(56) References Cited

U.S. PATENT DOCUMENTS

| | | | | |
|---|---|---|---|---|
| 4,430,406 | A | 2/1984 | Newkirk et al. | |
| 4,557,687 | A * | 12/1985 | Schirneker | F23D 3/02 126/96 |
| 4,774,032 | A * | 9/1988 | Coates | A61M 16/18 128/204.13 |
| 4,805,589 | A * | 2/1989 | Nakanishi | F23D 3/18 126/96 |
| 5,529,485 | A * | 6/1996 | D'Ambro | F23D 3/18 431/298 |
| 6,991,453 | B2 * | 1/2006 | Decker | A61L 9/037 126/45 |
| 7,275,539 | B2 | 10/2007 | Gippert | |
| 7,287,979 | B2 * | 10/2007 | Backes | F23D 5/04 431/338 |
| 7,568,913 | B2 * | 8/2009 | Decker | A61L 9/037 431/298 |
| 9,476,586 | B2 * | 10/2016 | Chen | F23D 3/24 |
| 9,651,246 | B2 * | 5/2017 | Chen | F23D 3/22 |
| 9,816,053 | B2 * | 11/2017 | DelCotto | C11C 5/006 |
| 9,885,474 | B2 | 2/2018 | Chen | |
| 10,011,805 | B2 * | 7/2018 | Ramaker | C11C 5/006 |
| 2004/0008509 | A1 * | 1/2004 | Decker | A61L 9/037 362/159 |
| 2004/0009447 | A1 | 1/2004 | Decker | |
| 2009/0238717 | A1 * | 9/2009 | Nolan | F23D 3/24 422/5 |
| 2009/0291400 | A1 * | 11/2009 | Levy | A61L 9/037 431/120 |
| 2011/0027736 | A1 * | 2/2011 | Decker | F23D 3/08 431/289 |
| 2012/0202160 | A1 | 8/2012 | Ford | |
| 2012/0264069 | A1 | 10/2012 | Ramirez | |
| 2013/0157207 | A1 | 6/2013 | Spangler | |
| 2013/0330678 | A1 | 12/2013 | Chen | |
| 2014/0057219 | A1 * | 2/2014 | Nolan | F23D 3/20 431/320 |
| 2015/0030988 | A1 * | 1/2015 | Chen | F23D 3/24 431/315 |
| 2017/0009997 | A1 * | 1/2017 | Yeh | F24C 3/022 |
| 2017/0009998 | A1 * | 1/2017 | Yeh | F24C 3/006 |
| 2017/0010001 | A1 * | 1/2017 | Yeh | F24C 3/004 |

FOREIGN PATENT DOCUMENTS

| | | | |
|---|---|---|---|
| JP | S61211611 | A | 9/1986 |
| JP | 2001065815 | A | 3/2001 |
| JP | 2007207597 | A | 8/2007 |
| TW | 201213725 | A | 4/2012 |
| TW | M443831 | U | 12/2012 |

* cited by examiner

WICK OF FLAME DEVICE

CROSS REFERENCE TO RELATED APPLICATION

The present application is a continuation application of U.S. patent application Ser. No. 14/302,485 filed on Jun. 12, 2014, of which the entire disclosure is incorporated herein.

BACKGROUND OF THE INVENTION

1. Field of the Invention

The present invention relates to a wick of a flame device and, more particularly, to a wick rolled from a metallic meshed body.

2. Description of the Related Art

Wicks in flame devices are used to maintain the flame scale or to evaporate noncombustible fuel or wax that cannot be ignited by an open flame directly. Conventional wicks are normally made out of braided cotton or fiber glass and liquid fuel or melted wax is drawn up through the wick to reach the flame by capillary action. After ignition, fuel vaporizes and combusts on tip of the wick. Being exposed to the flame, the tip of the cotton wick will be carbonized and burnt out gradually due to high temperature on the top of the flame. Thus, a wick made of consumable material and exposed to high temperature must be adjusted and trimmed every once in a while to maintain combustion. Moreover, wicks produce a diffusion flame as oxygen reacts with vaporized fuel by diffusion. The flame speed is limited by the rate of diffusion because there is not sufficient oxygen for the reaction of complete combustion. As a result, diffusion flames produced by a wick tend to produce incomplete combustion and more soot particles than premixed flames when the flame scale is enlarged.

U.S. Patent Publication No. 2012/0202160 shows a candle with a ribbon style wick disposed in a candle body. The wick creates a shape in addition to the shape of the wick material itself. The shape of the wick material prior to shaping for use in the candle is in the form of a roll. A flame of the candle takes on the shape created by the placement of the wick. The wick is made of porous material, so that the wick can draw fuel upward to the flame by capillary action. The capillary flow rate is determined by the pore size and density of the wick material and the fuel. If the pore size and density of the wick material is uniform, the wicking capability on each cross-section that draws fuel is fixed. When the wick is in the form of a thin ribbon, it has fewer pores in cross-section and has weaker capillary flow that results in a smaller flame scale during combustion.

If a larger flame scale is needed, one can increase the thickness of the wick that includes more pores on the same cross-section to induce a larger capillary flow rate. However, increase of the wick thickness may cause some drawbacks. Since the pores inside the wick can also absorb fuel, the percentage of the wick's surface area that fuel contacts air directly is reduced when the wick is thickened. A thick wick decreases the efficiency to evaporate fuel and makes it difficult to be lit when the pores in the wick are oversaturated and accumulated with fuel. When a thick wick is lit, fuel inside the pores away from the wick surface is also heated but cannot evaporate properly. It may cause over-heated fuel to expand suddenly and to splash the fuel droplets out of the wick. The problem may deteriorate when using a larger thick wick and a fuel that has a high flash point with a high viscosity.

More important, the wick uses the heat of the flame itself to vaporize its fuel and diffuses the oxidizer (oxygen) into the flame from the surrounding air. The oxygen combines with the fuel by diffusion, and the flame speed is limited by the rate of diffusion. Also, heat generated by the flame also creates convection to carry the hot combustion products away from the fuel source. Therefore, diffusion flames tend to burn slow and to produce soot particles, because there may not be sufficient oxygen for the reaction of complete combustion. Although soot particles typically produced in a diffusion flame becomes incandescent from the heat of the flame and causes the flame to be bright orange-yellow color, incomplete combustion not only produces soot particles but also toxic fumes. It is harmful and even dangerous to users when the flame scale is increased for incomplete combustion. Furthermore, a user has to attend and adjust the wick constantly to control the flame scale, because the wick can burn out due to a high flame temperature. Flame scale varies as the height of the wick relative to fuel changes during combustion. It is thus inconvenient for a user to maintain a stable flame.

The present invention is, therefore, intended to obviate or minimize the problems encountered in the prior art.

SUMMARY OF THE INVENTION

In a diffusion flame produced by a wick, combustion takes place at the flame surface only, where the fuel meets oxygen in the right concentration. The interior of the flame contains unburnt vaporized fuel. The present invention can substantially improve the combustion efficiency, can increase the flame scale without compromising the combustion efficiency, and can induce a more complete combustion in diffusion combustion. It is achieved by adjusting the wick's pores number, density and surface area that is exposed to flame and surrounding air on the top of the wick. When the flame scale increases, a stronger convection is also created to carry the hot combustion products away from the fuel source quicker due to a stack effect. Since the diffusion flames burning speed is slow, a larger flame scale usually results in producing more soot particles due to more incomplete combustion. To overcome the restriction, in the proposed invention, the rolled mesh member forms a semi-open chamber that opens on the top edges of the wick. The proposed wick material is made of metal mesh which is non-consumable at a high temperature and can reach a higher temperature than conventional wicks during combustion. As a result, this semi-opened chamber in the wick not only increases the surface area that is exposed to the flame and surrounding air for better fuel evaporation but also provides a high temperature zone that can slow down the hot combustion products being carried away by a strong convection for a larger flame scale to achieve complete combustion.

According to the present invention, a wick of a flame device configured from a single metallic meshed wick material continuously includes a spiral section with a shape including at least one loop, with the at least one loop curled about an imaginary axis, and in which the metallic meshed wick material is curled about the imaginary axis to include the at least one loop. A folded section has a shape including a fold, a first length extending away from the spiral section to the fold and along a first imaginary plane and a second length extending from the fold to the spiral section and along a second imaginary plane. The first and second imaginary planes extend in parallel, and the metallic meshed wick material is folded to include the first length extending away from the spiral section and along the first imaginary plane and the second length extending to the spiral section and along the second imaginary plane. A wrapped section has a shape including at least one contour conforming shape of the spiral and folded sections, and the metallic meshed wick material is wrapped to include the at least one contour around the spiral and folded sections. The folded section is shaped after the spiral section.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an object of the present invention to provide a wick of a flame device that has a good capillary action, evaporates fuel fast, and maintains a stable flame conveniently without trouble.

Other objects, advantages, and new features of the present invention will become apparent from the following detailed description of the invention when considered in conjunction with the accompanied drawings.

DETAILED DESCRIPTION OF THE INVENTION

Figure 1:
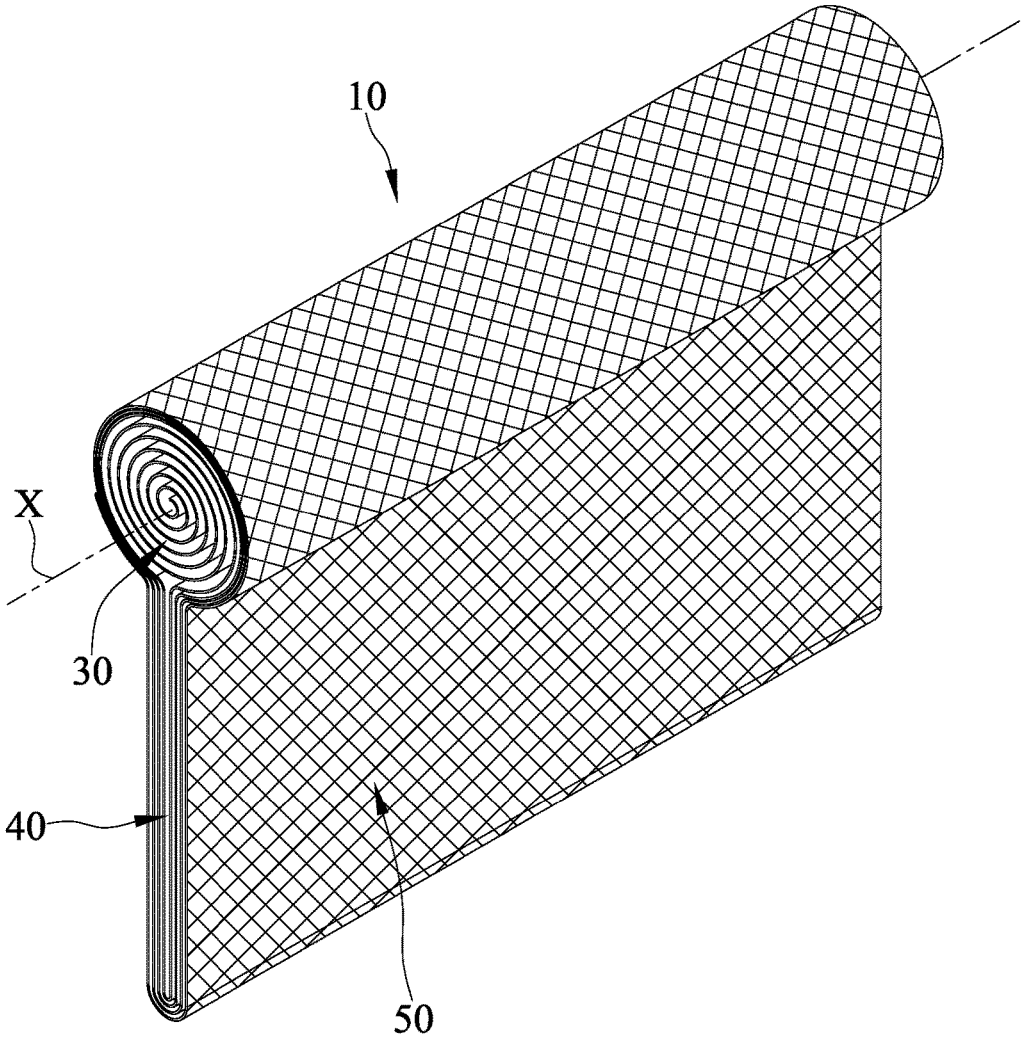
FIG. 1 is a perspective view of a wick of a flame device in accordance with a first embodiment of the present invention.
Figure 2:
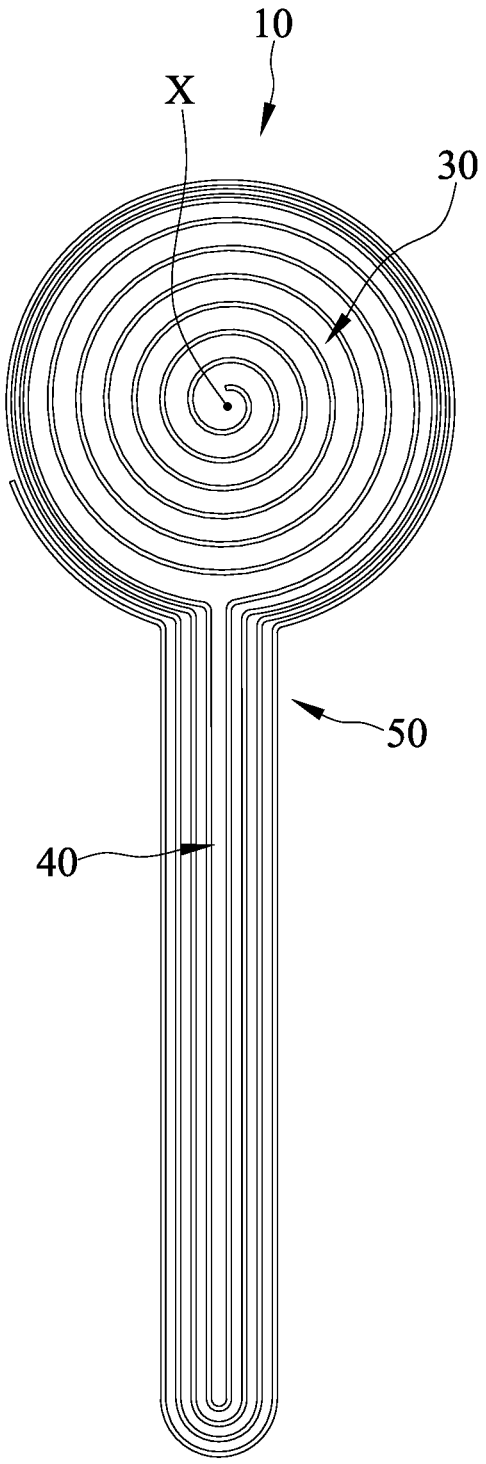
FIG. 2 is a side view of FIG. 1.
Figure 3:
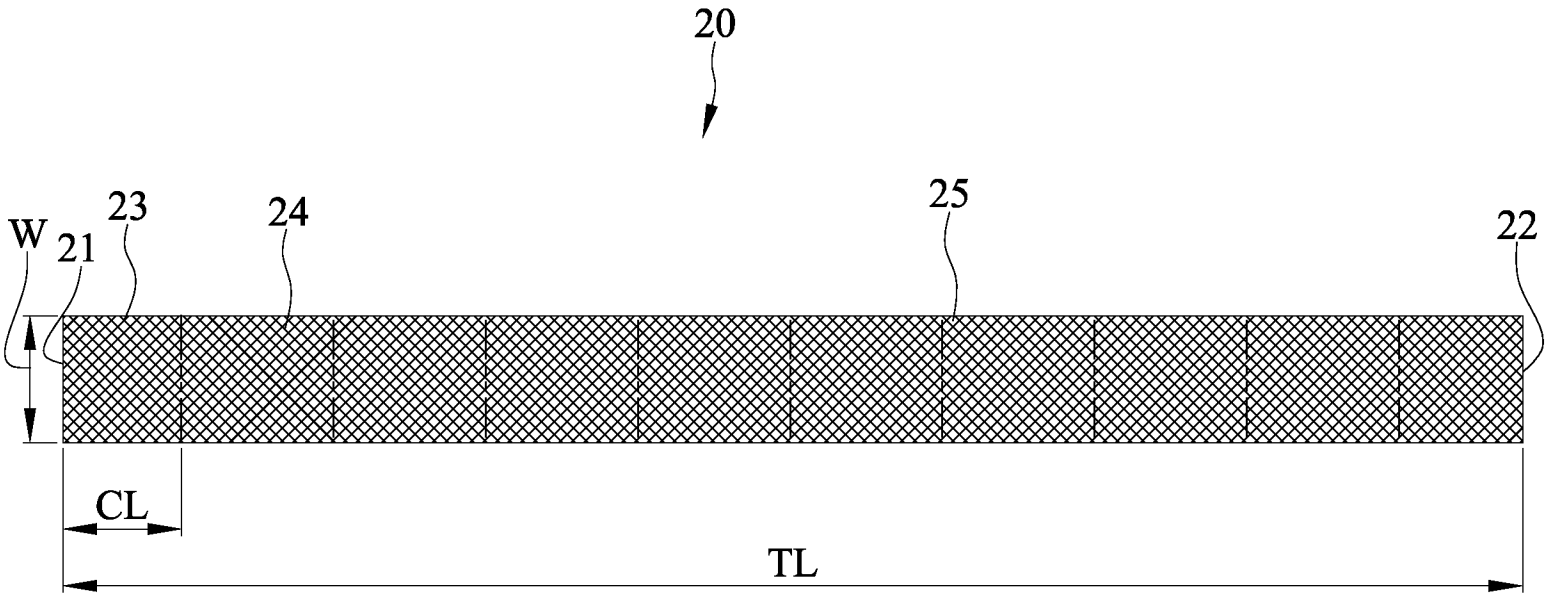
FIG. 3 shows a wick material of the wick of the first embodiment.
Figure 4:
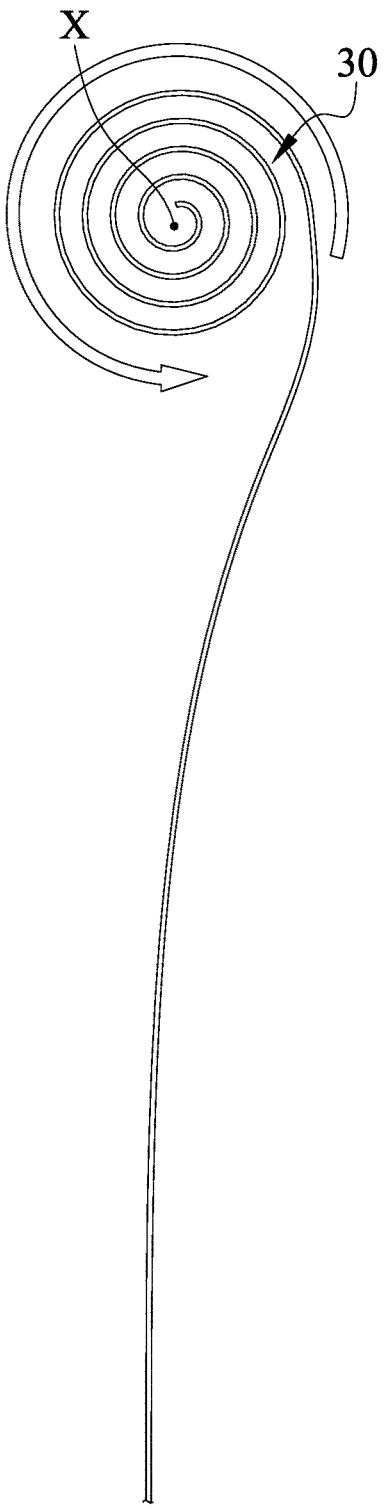
FIG. 4 shows the wick material curled to include a spiral section.
Figure 5:
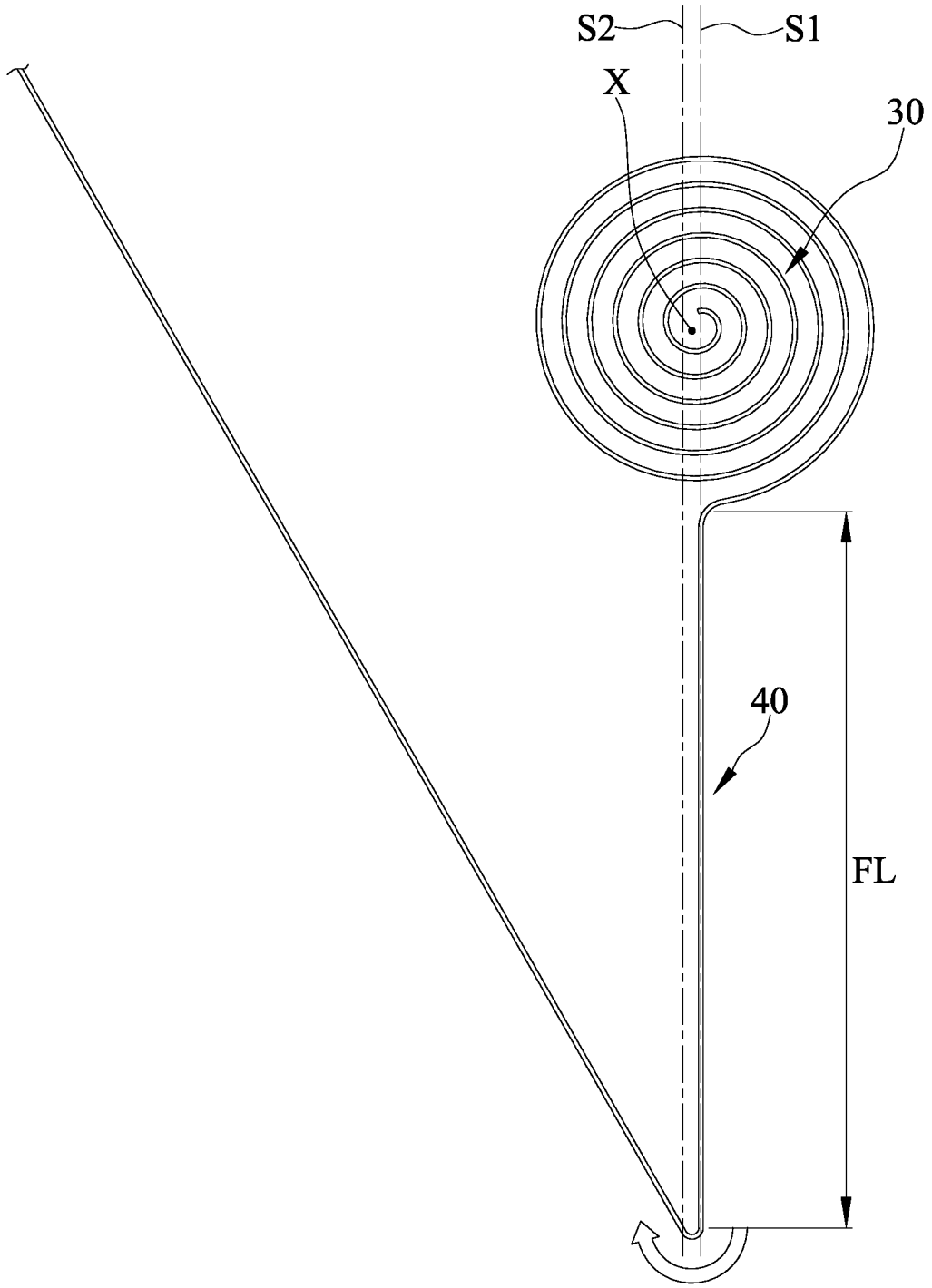
FIG. 5 is a continued view of FIG. 4, with the wick material folded to include a fold section.
Figure 6:
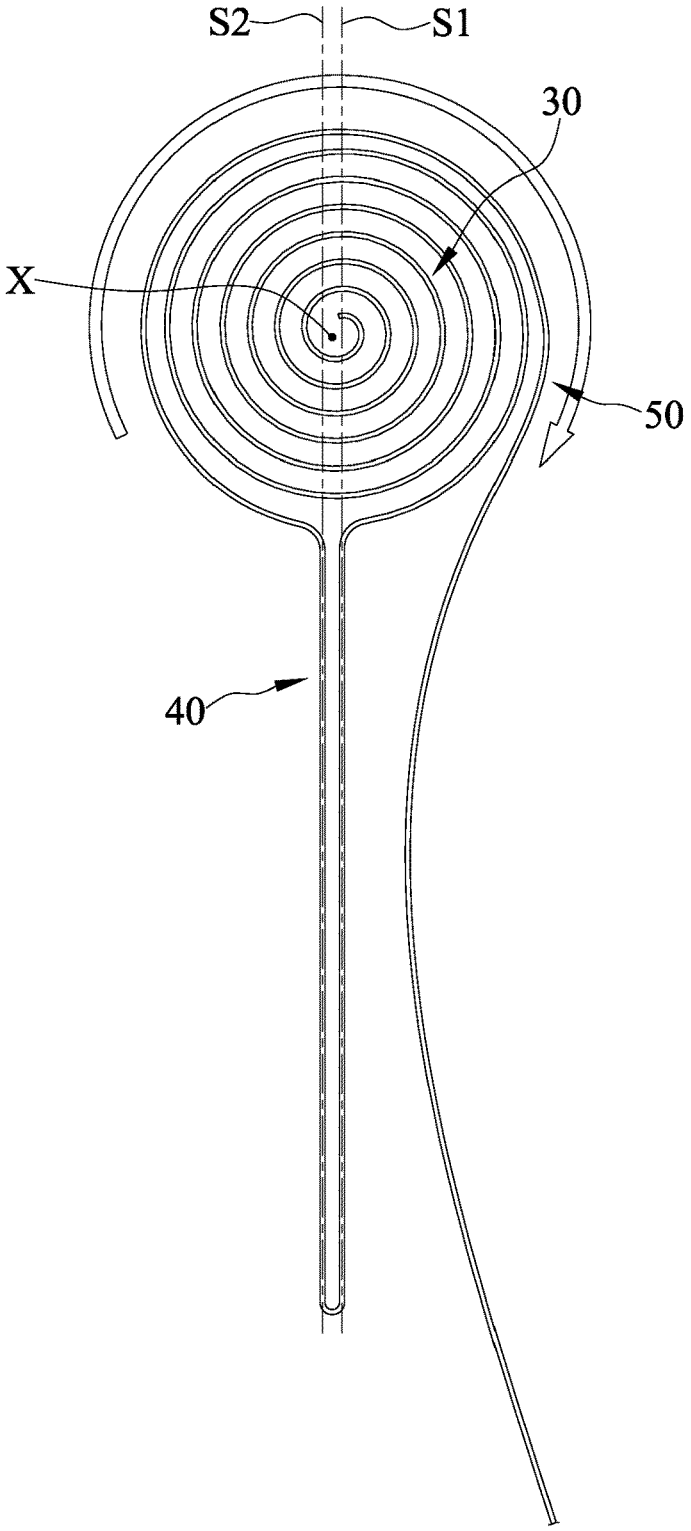
FIG. 6 is a continued view of FIG. 5, with the wick material shaped to include more concentric loops at the spiral section and more folds at the folded section.
Figure 7:
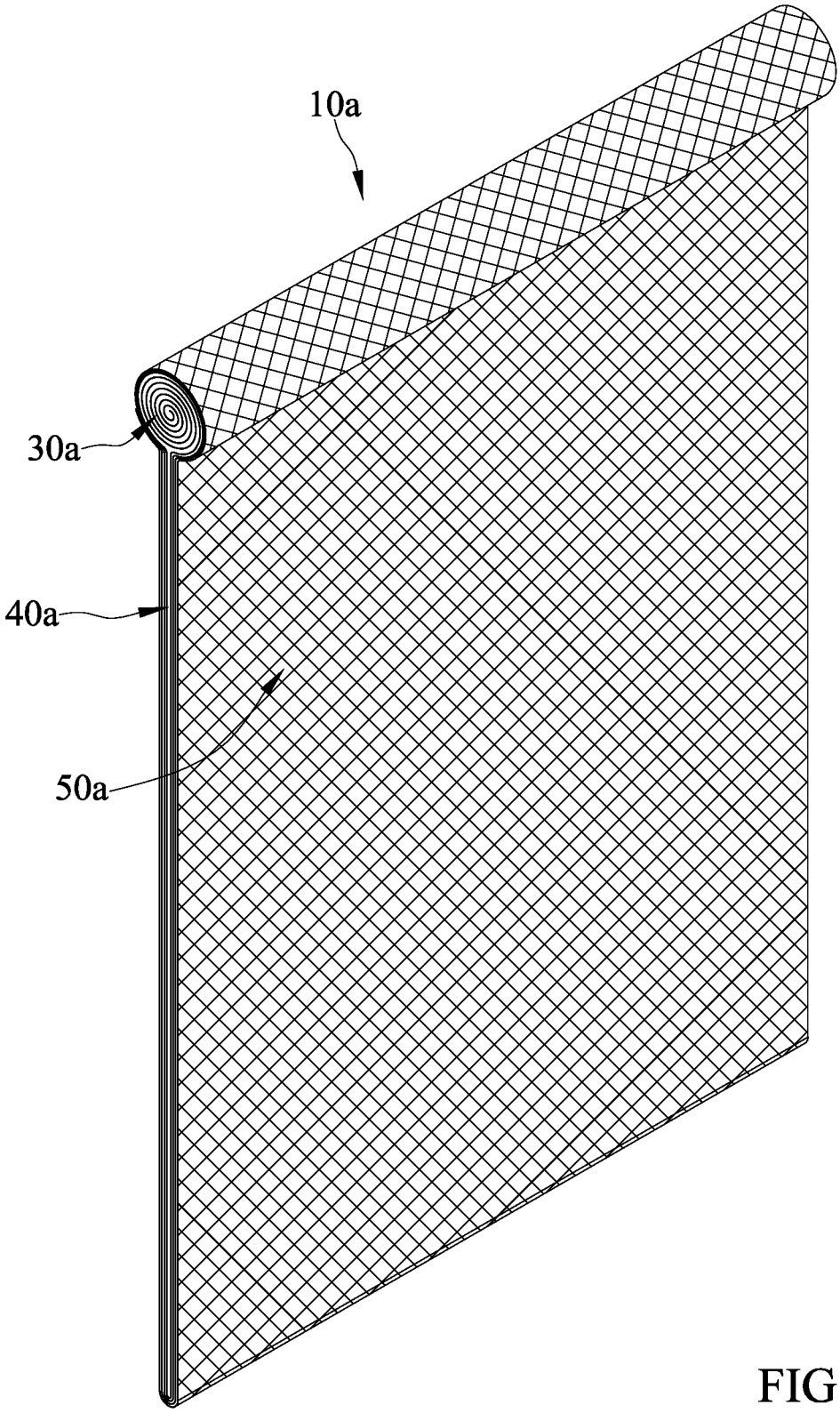
FIG. 7 is a perspective view of a wick of a flame device in accordance with a second embodiment of the present invention.

FIGS. 1 through 7 show a wick 10 of a flame device in accordance with a first embodiment of the present invention. The wick 10 is configured from a single metallic meshed wick material 20 continuously and includes a spiral section 30, a folded section 40, and a wrapped section 50. The metallic meshed wick material 20 is in the form of a ribbon, which is long and has flat surfaces.

The spiral section 30 is with a shape including at least one loop curled about an imaginary axis X, and in which the metallic meshed wick material 20 is curled about the imaginary axis X to include the at least one loop.

The folded section 40 is with a shape including a fold, a first length extending away from the spiral section 30 to the fold and along a first imaginary plane S1 and a second length extending from the fold to the spiral section 30 and along a second imaginary plane S2. The first and second imaginary planes S1 and S2 extend in parallel, and the metallic meshed wick material 20 is folded to include the first length extending away from the spiral section 30 and along the first imaginary plane S1 and the second length extending to the spiral section 30 and along the second imaginary plane S2. A distance between the first and second imaginary planes S1 and S2 is smaller than a diameter of the spiral section 30 about the imaginary axis X. The first and second imaginary planes S1 and S2 are on opposite sides of and equally spaced from the imaginary axis X. The folded section 40 is shaped after the spiral section 30.

The wrapped section 50 is with a shape including at least one contour conforming the shapes of the spiral and folded sections 30 and 40, and the metallic meshed wick material 20 is wrapped to include the at least one contour around the spiral and folded sections 30 and 40. The wrapped section 50 includes three contours wrapping the spiral and folded sections 30 and 40.

The metallic meshed wick material 20 has a head end 21 and a tail end 22 and defines first, second, and third sections 23, 24, and 25 subsequently in a direction from the head end 21 toward the tail end 22. The first, second and third sections 23, 24, and 25 are shaped to form the spiral, folded and wrapped sections 30, 40, and 50 of the wick 10, respectively. The tail end 22 defines a finish end of the wrapped section 50. The finish end of the wrapped section 50 is disposed adjacent to the spiral section 30.

The metallic meshed wick material 20 includes an overall length TL, between the head and tail ends 21 and 22, in a range between 500 and 550 mm. The overall length TL of the metallic meshed wick material 20 is 525 mm. The metallic meshed wick material 20 includes a width W in a range between 10 and 50 mm. The width W of the metallic meshed wick material 20 is in a range between 20 and 45 mm. The first section 23 of the metallic meshed wick material 20 measures a length CL in a range between 40 and 45 mm. The length CL of the first section 23 of the metallic meshed wick material 20 is 42 mm. The second section 24 of the metallic meshed wick material 20 measures a length FL in a range between 50 and 55 mm. The length FL of the second section 24 of the metallic meshed wick material 20 is 54 mm.

Figure 8:
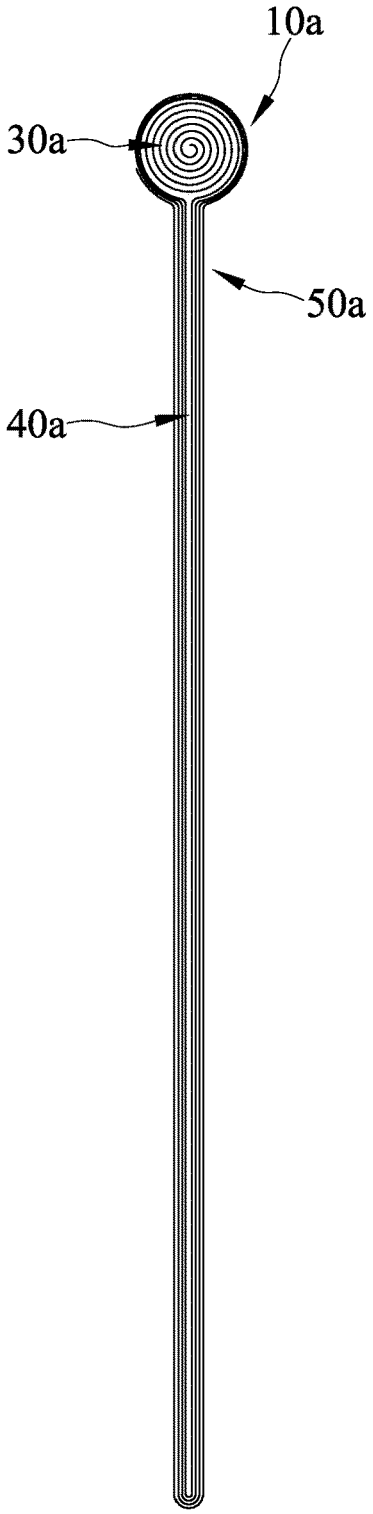
FIG. 8 is a side view of FIG. 7.
Figure 9:
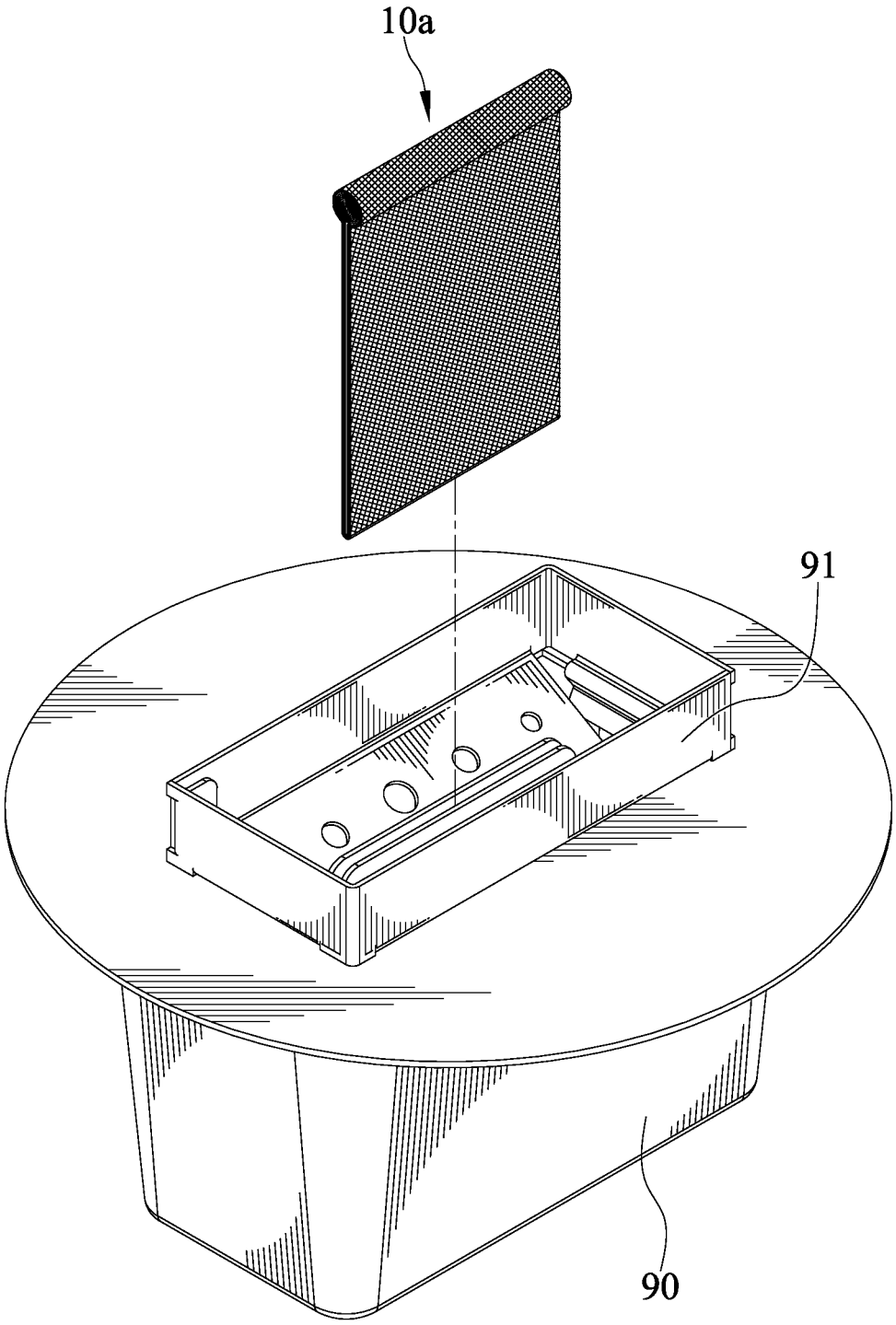
FIG. 9 is an exploded perspective view of a flame device with a wick of the second embodiment.
Figure 10:
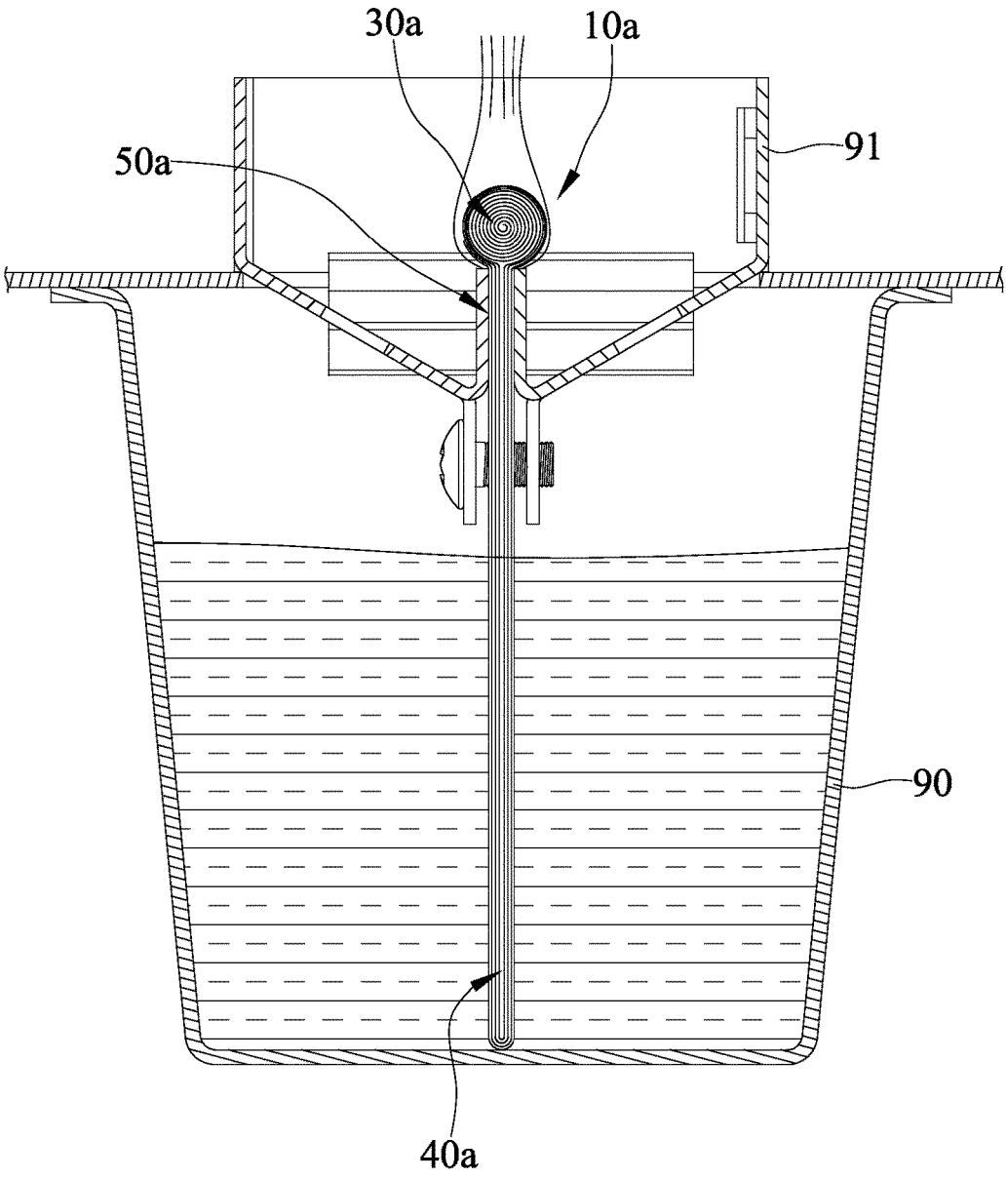
FIG. 10 is a cross-sectional view of FIG. 9, with the wick disposed in the flame device and drawing fuel to a flame.

FIGS. 8 through 10 show a wick 10*a* of a flame device in accordance with a second embodiment of the present invention, and the same numbers are used to correlate similar components of the first embodiment, but bearing a letter a. The wicks 10 and 10*a* are of similar configuration except that the wick 10*a* has a longer length than that of the wick 10 and proportions between spiral, folded, and wrapped sections 30*a*, 40*a*, and 50*a* are different from proportions between the spiral, folded, and wrapped sections 30, 40, and 50.

In addition, FIG. 9 shows a flame device 90 with the wick 10*a*. The flame device 90 includes a fuel reservoir and a modular wick holder 91 disposed on the fuel reservoir. The modular wick holder includes a first wick holder assembly and a second wick holder assembly joined together. The first and second wick holder assemblies are disposed symmetrical to each other. The first wick holder assembly includes a first projection, and the second wick holder assembly includes a second projection opposite and corresponding to the first projection. The first and second projections delimit a space therebetween. When the modular wick holder and the wick 10*a* are combined, the wick 10*a* is securely held by the space. At least one adjusting member inserts through the first and second wick holder assemblies and is operable to make the first and second projections closer and the space include a reduced size.

Figure 11:
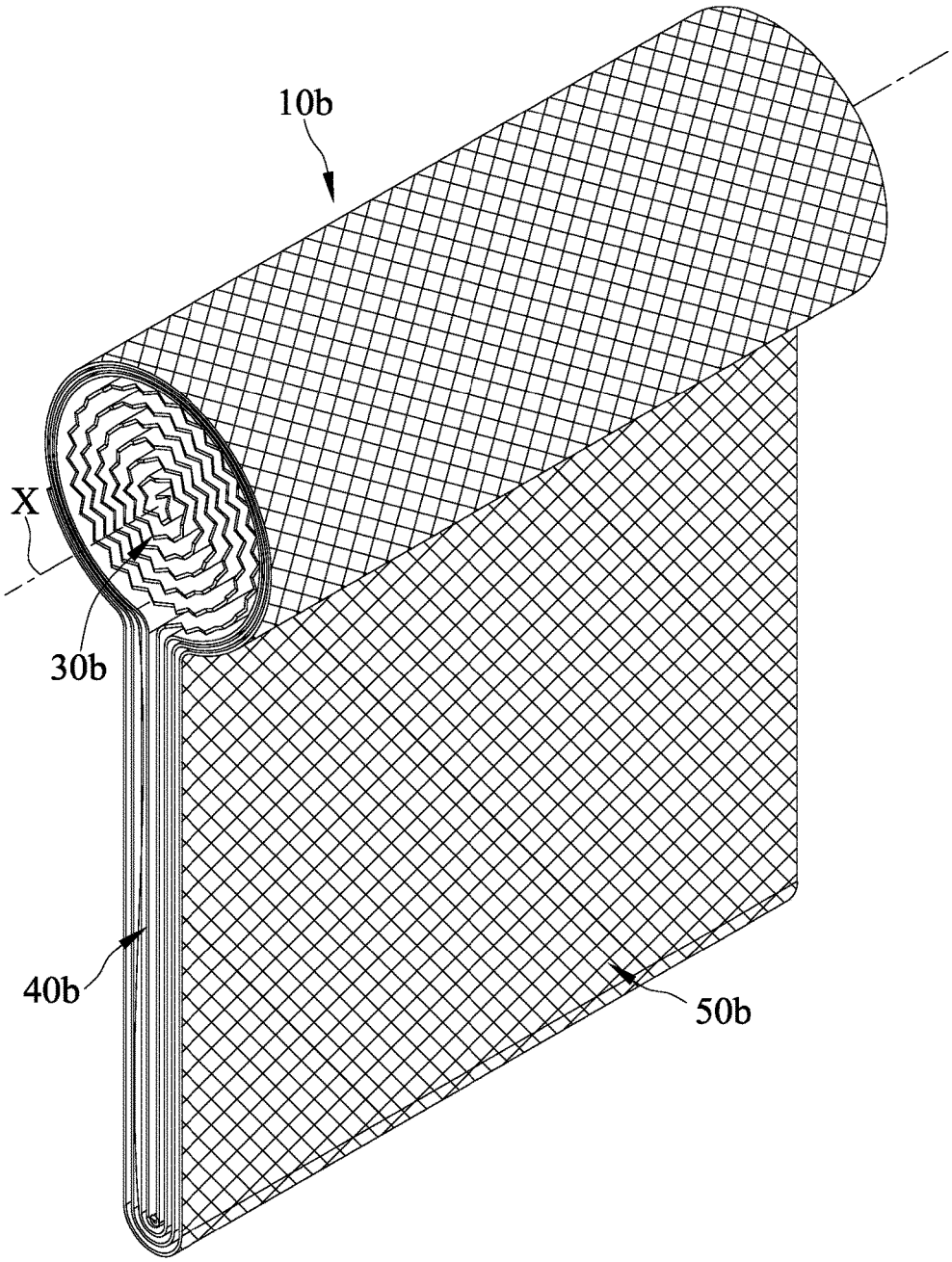
FIG. 11 is a perspective view of a wick of a flame device in accordance with a third embodiment of the present invention.
Figure 12:
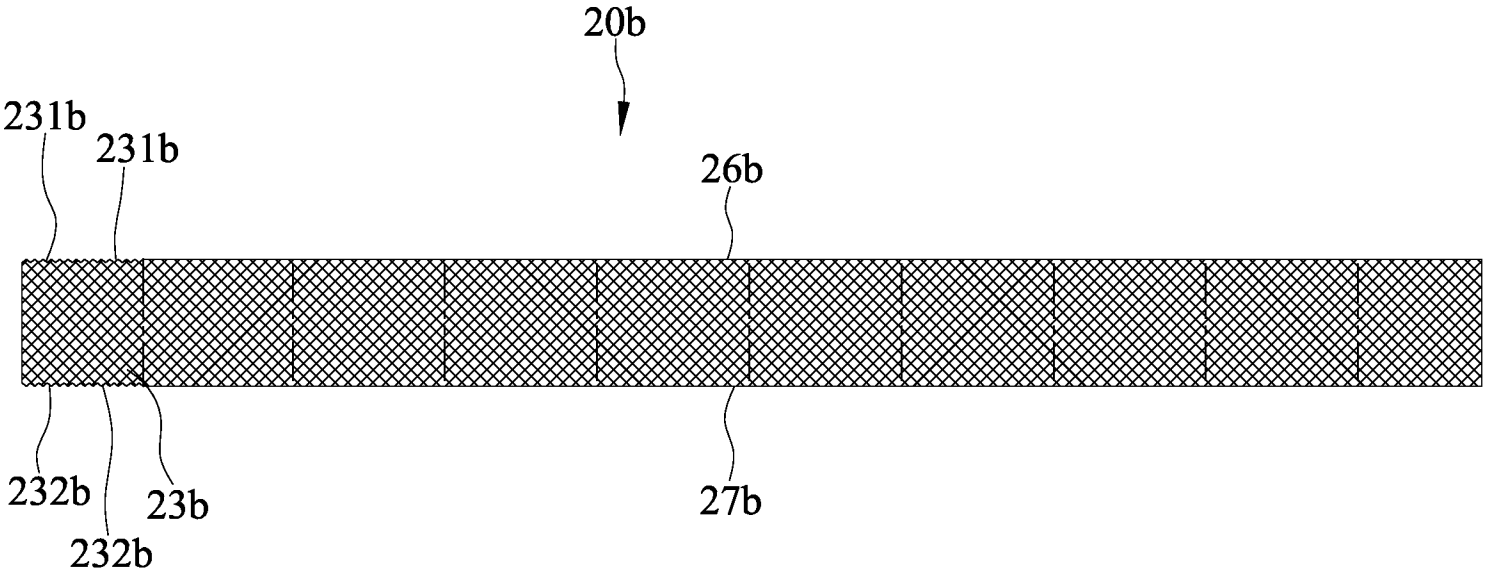
FIG. 12 shows a wick material of the wick of the third embodiment.

FIGS. 11 and 12 show a wick 10*b* of a flame device in accordance with a third embodiment of the present invention, and the same numbers are used to correlate similar components of the first embodiment, but bearing a letter b. The wicks 10 and 10*b* are of similar configuration except that the wick 10*b* has a length different from that of the wick 10 and proportions between spiral, folded, and wrapped sections 30*b*, 40*b*, and 50*b* are different from proportions between the spiral, folded, and wrapped sections 30, 40, and 50.

In addition, a metallic meshed wick material 20*b* has first and second lateral sides 26*b* and 27*b*. The first and second lateral sides 26*b* and 27*b* face opposite to each other in a width direction. The width W of the metallic meshed material 20*b* is measured in the width direction. The first section 23*b* of the metallic meshed wick material 20*b* has at least one first notch 231*b* on one of the first and second lateral sides 26*b* and 27*b*. The first section 23*b* of the metallic meshed wick material 20*b* has at least one second notch 232*b* on the other of the first and second lateral sides 26*b* and 27*b*. The wick 10*b* includes the at least one loop of the spiral section 30*b* including the at least one first notch 231*b*, and the at least one first notch 231*b* is recessed in a direction parallel to the imaginary axis X. The wick 10*b* includes the at least one loop of the spiral section 30*b* including the at least one second notch 232*b*, and the at least one second notch 232*b* is recessed in a direction parallel to the imaginary axis X. The first section 23*b* of the metallic meshed wick material 20*b* has a plurality of first and second notches 231*b* and 232*b*. Each of the plurality of first and second notches 231*b* and 232*b* improves the speed that the spiral section 30*b* evaporates fuel.

Figure 13:
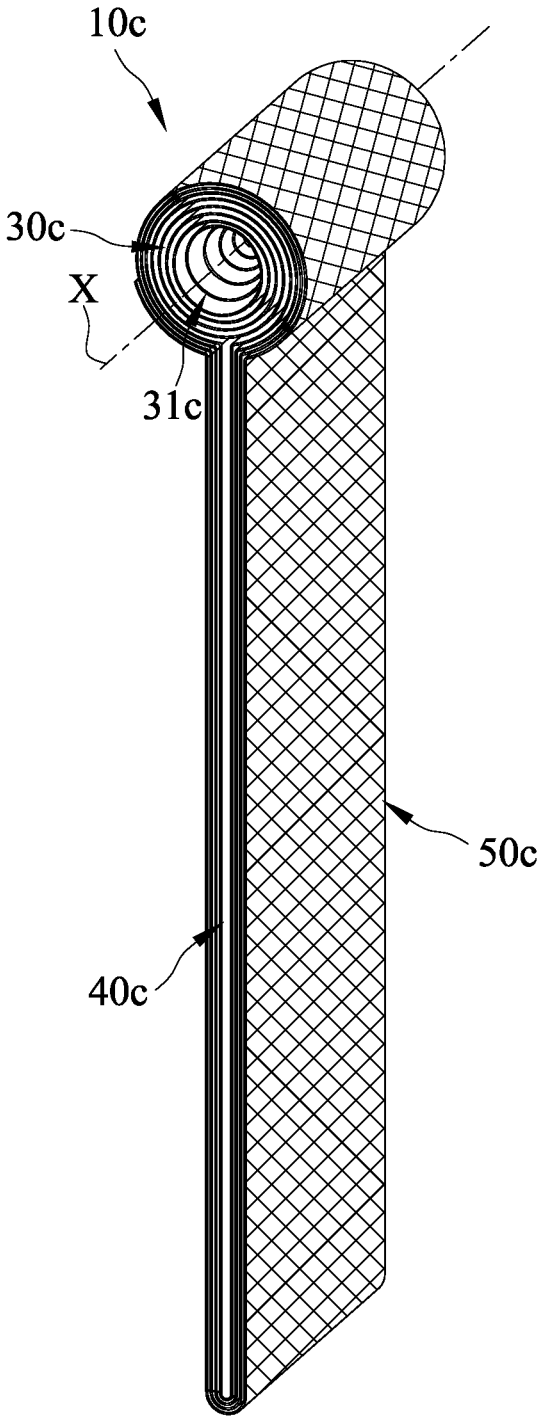
FIG. 13 is a perspective view of a wick of a flame device in accordance with a fourth embodiment of the present invention.
Figure 14:
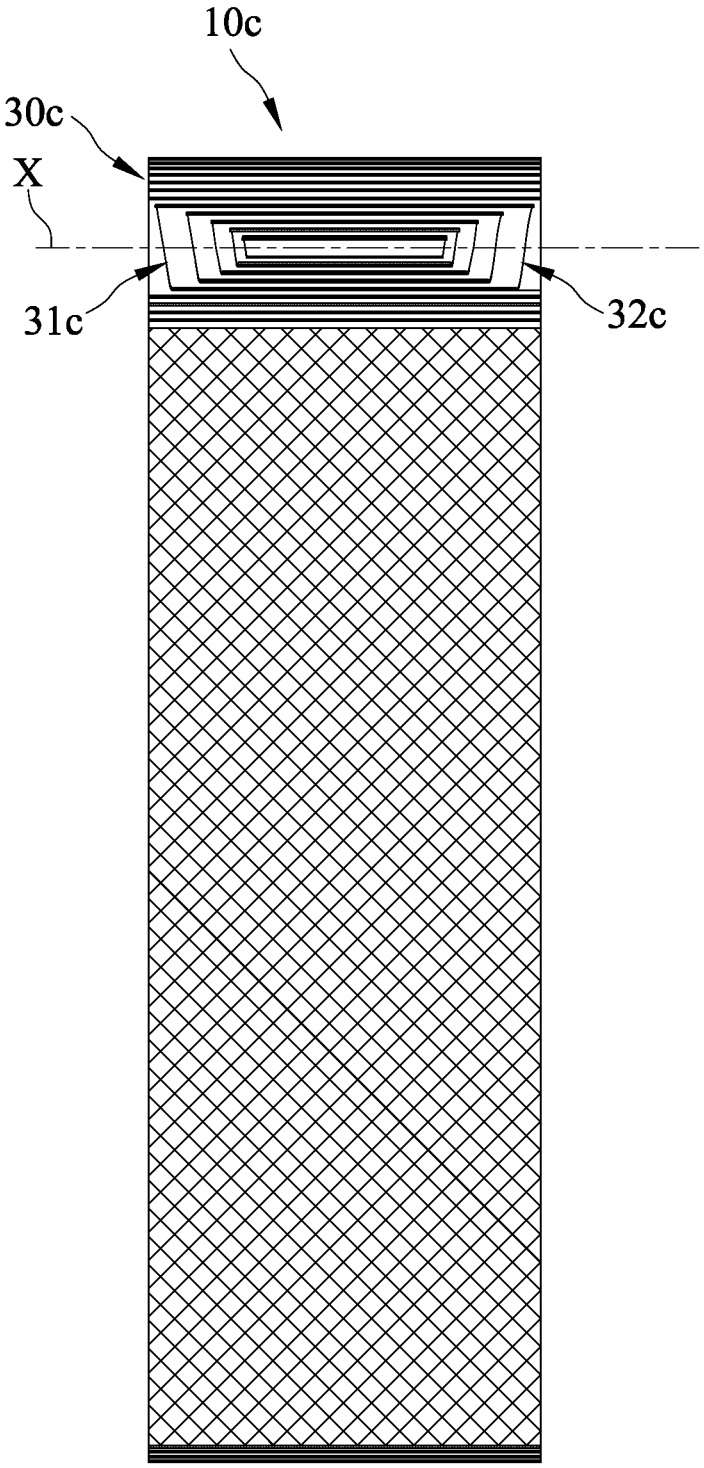
FIG. 14 is a cross-sectional view of FIG. 13.
Figure 15:
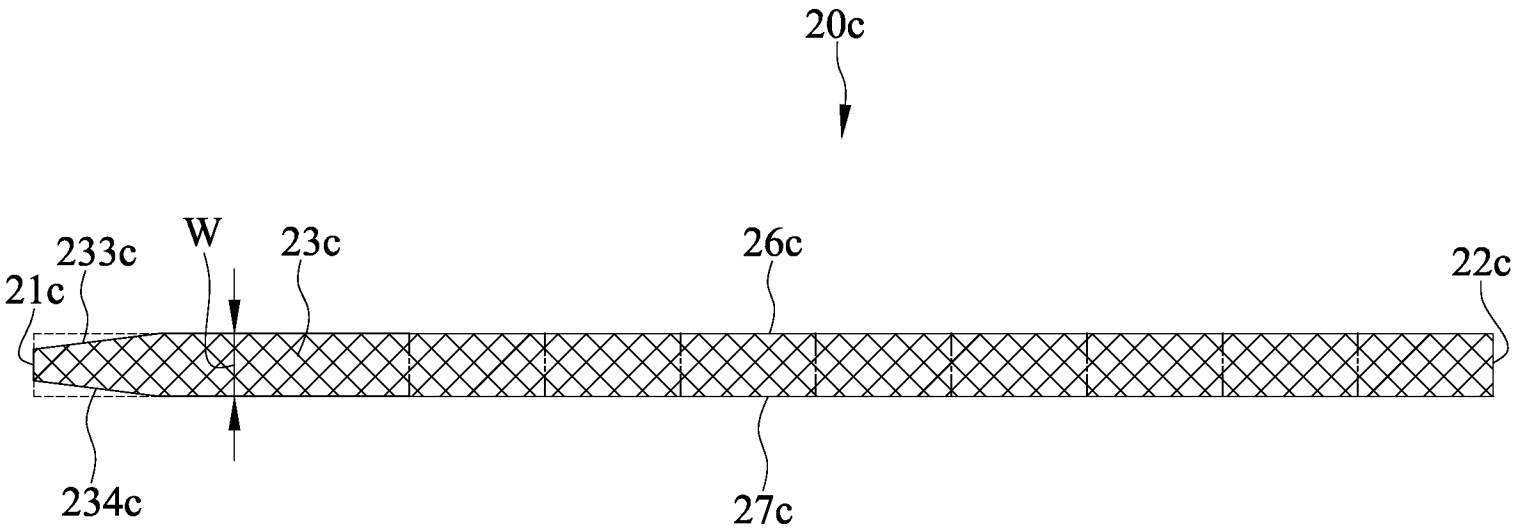
FIG. 15 shows a wick material of the wick of the fourth embodiment.

FIGS. 13 through 15 show a wick 10*c* of a flame device in accordance with a fourth embodiment of the present invention, and the same numbers are used to correlate similar components of the first embodiment, but bearing a letter c. The wicks 10 and 10*c* are of similar configuration except that the wick 10*c* has a length different from that of the wick 10 and proportions between spiral, folded, and wrapped sections 30*c*, 40*c*, and 50*c* are different from proportions between the spiral, folded, and wrapped sections 30, 40, and 50.

In addition, a metallic meshed wick material 20*c* has a tail end 22*c* and first and second lateral sides 26*c* and 27*c*, and the first section 23*c* of the metallic meshed wick material 20*c* has a first chamfer 233*c* extending from the head end 21*c* to one of the first and second lateral sides 26*c* and 27*c*. The wick 10*c* includes the at least one loop of the spiral section 30*c* including the at least one first chamfer 233*c*. Each of the plurality of loops of the spiral section 30*c* is of a length along the imaginary axis X. The plurality of loops of the spiral section 30*c* has different lengths. The plurality of loops delimits the spiral section 30*c* with a first concave end 31*c*. The first concave end 31*c* is of a depth along the imaginary axis X and has a reduced diametrical dimension with respect to the imaginary axis X proportional to the depth. The first section 23*c* of the metallic meshed wick material 20*c* has a second chamfer 234*c* extending from the head end 21*c* to the other of the first and second lateral sides 26*c* and 27*c*. The plurality of loops delimits the spiral section 30*d* with a second concave end 32*c*. The first and second concave ends 31*e* and 32*c* are opposite to each other. The second concave end 32*c* is of a depth along the imaginary axis X and has a reduced diametrical dimension with respect to the imaginary axis X proportional to the depth. The first and second chamfers 233*c* and 234*c* improve the speed that the spiral section 30*c* evaporates fuel. The first and second chamfers 233*c* and 234*c* have the same triangular shape.

Figure 16:
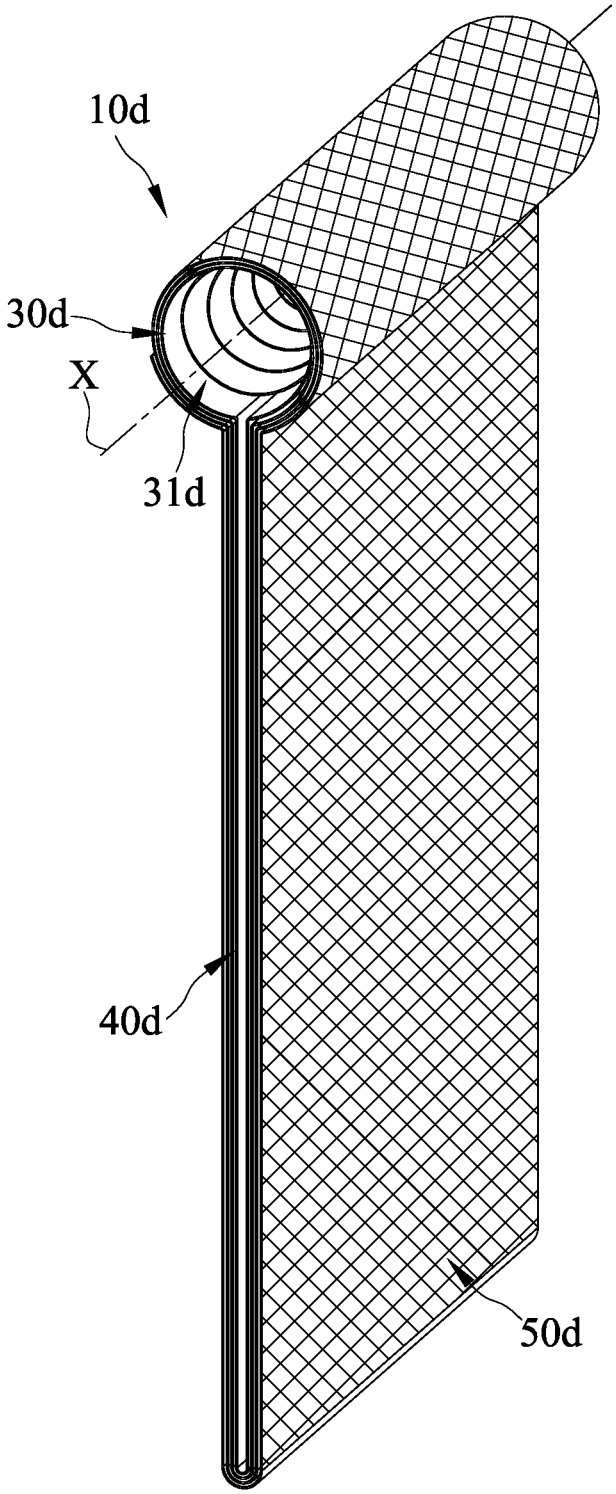
FIG. 16 is a perspective view of a wick of a flame device in accordance with a fifth embodiment of the present invention.
Figure 17:
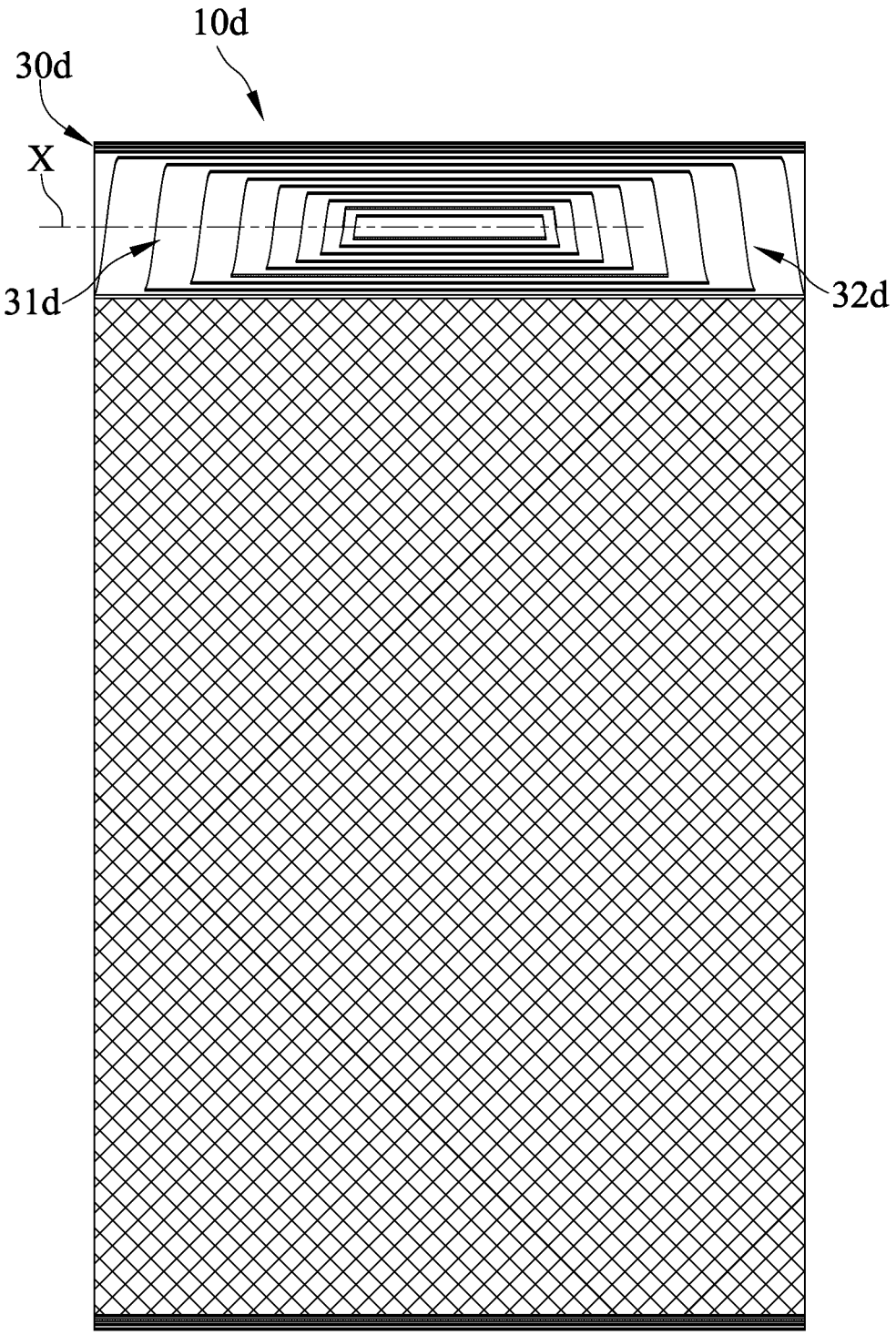
FIG. 17 is a cross-sectional view of FIG. 15.
Figure 18:
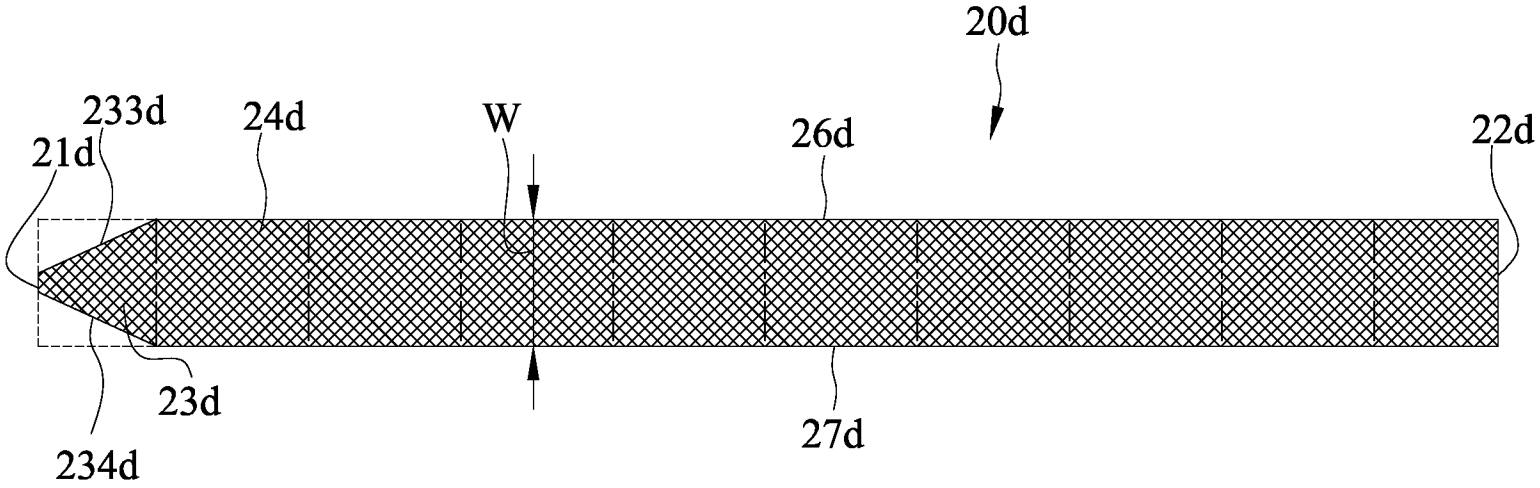
FIG. 18 shows a wick material of the wick of the fifth embodiment.

FIGS. 16 through 18 show a wick 10*d* of a flame device in accordance with a fifth embodiment of the present invention, and the same numbers are used to correlate similar components of the first embodiment, but bearing a letter d. The wicks 10 and 10*d* are of similar configuration except that the wick 10*d* has a length different from that of the wick 10 and proportions between spiral, folded, and wrapped sections 30*d*, 40*d*, and 50*d* are different from proportions between the spiral, folded, and wrapped sections 30, 40, and 50.

In addition, a metallic meshed wick material 20*d* has a tail end 22*d*, a second section 24*d*, and first and second lateral sides 26*d* and 27*d*, and the first section 23*d* of the metallic meshed wick material 20*d* has a first chamfer 233*d* extending from the head end 21*d* to one of the first and second lateral sides 26*d* and 27*d*. The wick 10*d* includes the at least one loop of the spiral section 30*d* including the at least one first chamfer 233*d*. Each of the plurality of loops of the spiral section 30*d* is of a length along the imaginary axis X. The plurality of loops of the spiral section 30*d* has different lengths. The plurality of loops delimits the spiral section 30*d* with a first concave end 31*d*. The first concave end 31*d* is of a depth along the imaginary axis X and has a reduced diametrical dimension with respect to the imaginary axis X proportional to the depth. The first section 23*d* of the metallic meshed wick material 20*d* has a second chamfer 234*d* extending from the head end 21*d* to the other of the first and second lateral sides 26*d* and 27*d*. The plurality of loops delimits the spiral section 30*d* with a second concave end 32*d*. The first and second concave ends 31*d* and 32*d* are opposite to each other. The second concave end 32*d* is of a depth along the imaginary axis X and has a reduced diametrical dimension with respect to the imaginary axis X proportional to the depth. The first and second chamfers 233*d* and 234*d* improve the speed that the spiral section 30*d* evaporates fuel. The first and second chamfers 233*d* and 234*d* have the same triangular shape.

In a real application test, as shown in appendix A, diffusion flames generated by the proposed invention almost do not produce soot particles. It can be proved either by observation from the flame color and does not therefore have a large portion of typical yellow flame. Even increase the flame scale, after long period of combustion in a closed room, the density of mono dioxide measured is still extremely low. This test can prove the effectiveness of the wicks 10, 10*a*, 10*b*, 10*c*, and 10*d* of the proposed invention. In addition, the wicks 10, 10*a*, 10*b*, 10*c*, and 10*d*, sampled as Biounifuel/COSFLAMES, also undergo a SGS combustion test, and the SGS combustion test report shows that the sample produces an extremely low density of mono dioxide.

In view of the forgoing, the wicks 10, 10*a*, 10*b*, 10*c*, and 10*d* are metallic, so they don't burn down and suffer a problem regarding a conventional wick that is made of cotton. Therefore, a user does not need to adjust the wicks 10, 10*a*, 10*b*, 10*c*, and 10*d* constantly to control the flame scale.

The wicks 10, 10*a*, 10*b*, 10*c*, and 10*d* are metallic, pliable and resilient, and include the spiral sections 30, 30*a*, 30*b*, 30*c*, and 30*d* and portions of the wrapped sections 50, 50*a*, 50*b*, 50*c*, and 50*d* which are wrapped around and have contours conforming with shapes of the spiral sections 30, 30*a*, 30*b*, 30*c*, and 30*d* tending to expand outward diametrically and creating semi-open chambers that open on the top edges of the wicks 10, 10*a*, 10*b*, 10*c*, and 10*d*, as best seen in FIG. 16. Each of these semi-opened chambers not only increases the surface area that exposes to flame and surrounding air for better fuel evaporation but also provides a zone that can slow down the hot combustion products being carried away by strong convection for a larger flame scale.

The wicks 10, 10*a*, 10*b*, 10*c*, and 10*d* can be held by the modular wick holder 91. It is convenient for a user to position the wicks 10, 10*a*, 10*b*, 10*c*, and 10*d* on the modular wick holder 91, because the spiral sections 30, 30*a*, 30*b*, 30*c*, and 30*d* of the wicks 10, 10*a*, 10*b*, 10*c*, and 10*d* are of a size greater than that of the space and the spiral section and each have an end that can abut against the modular wick holder 91. In addition, the spiral sections 30, 30*a*, 30*b*, 30*c*, and 30*d* of the wicks 10, 10*a*, 10*b*, 10*c* each have an enlarged cross section, thereby evaporating fuel at a faster rate. Then, the wicks 10, 10*a*, 10*b*, 10*c*, and 10*d* can be easily ignited.

The wicks 10, 10*a*, 10*b*, 10*c*, and 10*d* draw fuel by capillary action. By changing sizes and numbers of the meshes, the fuel transmission rate of the wicks 10, 10*a*, 10*b*, 10*c*, and 10*d* are adjusted. The wicks 10, 10*a*, 10*b*, 10*c*, and 10*d*, however, are modified in the number of the contours and in the length in respect of fuels of different viscosity or having different ignition points. Modifications in the number of the loops and the diameter of the spiral sections 30, 30*a*, 30*b*, 30*c*, and 30*d* can change an area in which fuel contacts air. The spiral sections 30, 30*a*, 30*b*, 30*c*, and 30*d* not only increase the number of meshes, thereby improving capillary capacity, but also prevent the wicks 10, 10*a*, 10*b*, 10*c*, and 10*d* from becoming oversaturated with fuel and suffering fuel accumulation. In addition, spaces between adjacent loops and contours can greatly improve the area in which fuel contacts air.

The spiral sections 30, 30*a*, 30*b*, 30*c*, and 30*d* under the heat can evaporate fuel at a greater rate, and fuel can discharge from two open ends of the spiral sections 30, 30*a*, 30*b*, 30*c*, and 30*d* that are on two ends of the imaginary axis X. Thus, it is easy to ignite the spiral section 30, 30*a*, 30*b*, 30*c*, and 30*d* from the two open ends. In addition, problems in which fuel can not evaporate easily and the wicks 10, 10*a*, 10*b*, 10*c*, and 10*d* can not be ignited easily if too much fuel is absorbed; fuel in a liquid state splashes out of the wicks 10, 10*a*, 10*b*, 10*c*, and 10*d*; and black smokes due to incomplete combustion, are overcome.

The spaces in the spiral sections 30, 30*a*, 30*b*, 30*c*, and 30*d* allow the spiral sections 30, 30*a*, 30*b*, 30*c*, and 30*d* to reach a high temperature, thereby improving the rate of fuel evaporation, and further to make the wicks 10, 10*a*, 10*b*, 10*c*, and 10*d* have a better combustion efficiency.

The foregoing is merely illustrative of the principles of this invention and various modifications can be made by those skilled in the art without departing from the scope and spirit of the invention.

What is claimed is:

1. A flame device comprising:

a fuel reservoir;

a modular wick holder disposed on the fuel reservoir and including a first wick holder assembly and a second wick holder assembly, wherein the first and second wick holder assemblies include an adjuster operably engaged therewith, wherein the first and second wick holder assemblies are joined together and disposed symmetrical to each other, wherein the first and second wick holder assemblies respectively include a first projection and a second projection disposed oppositely and correspondingly, wherein the first and second projections delimit a space therebetween, and wherein a size of the space is adapted to be changed by operating the adjuster;

a wick configured from a single metallic meshed wick material respectively forming a spiral section, a flat folded section, and a wrapped section, wherein the spiral section, the flat folded section and the wrapped section are continuously connected, wherein the spiral section includes at least one loop curled about an imaginary axis, wherein the flat folded section extends from the spiral section and includes a first length extending away from the spiral section along a first imaginary plane to a fold and a second length extending from the fold toward the spiral section along a second imaginary plane, wherein the first and second imaginary planes extend in parallel and are disposed in a spaced relationship with each other, wherein the first and second imaginary planes are spaced and a distance therebetween is smaller than a diameter of the spiral section about the imaginary axis, wherein the wrapped section extends from the flat folded section and includes at least one contour conforming with a shape wrapping around the spiral section and the first and second lengths and the fold of the flat folded section, and wherein the wick is securely held in the space.

2. The flame device as claimed in claim 1, wherein the metallic meshed wick material has a head end and a tail end and defines first, second, and third sections subsequently in a direction from the head end toward the tail end, wherein the first, second and third sections are shaped to form the spiral, folded and wrapped sections of the wick, respectively, and wherein the tail end defines a finish end of the wrapped section.

3. The flame device as claimed in claim 2, wherein the finish end of the wrapped section is disposed adjacent to the spiral section.

4. The flame device as claimed in claim 2, wherein the single metallic meshed wick material includes an overall length, between the head and tail ends, in a range between 500 and 550 mm, wherein the single metallic meshed wick material includes a width in a range between 10 and 50 mm, and wherein the first section of the single metallic meshed wick material measures a length in a range between 40 and 45 mm.

5. The flame device as claimed in claim 4, wherein the overall length of the single metallic meshed wick material is 525 mm, wherein the width of the single metallic meshed wick material is in a range between 20 and 45 mm, and wherein the first section of the single metallic meshed wick material measures a length in a range between 40 and 45 mm.

6. The flame device as claimed in claim 2, wherein the first section of the single metallic meshed wick material has first and second lateral sides, wherein one of the first and second lateral sides includes at least one first notch, and wherein when the spiral section is formed, the at least one first notch recesses in a direction parallel to the imaginary axis.

7. The flame device as claimed in claim 6, wherein the first section of the metallic meshed wick material includes another of the first and second lateral sides having at least one second notch, and wherein when the spiral section is formed, the at least one second notch recesses in a direction parallel to the imaginary axis.

8. The flame device as claimed in claim 7, wherein the at least one first and second notches comprises a plurality of first and second notches.

9. The flame device as claimed in claim 2, wherein the first section of the single metallic meshed wick material has a first chamfer extending from the head end to one of the first and second lateral sides.

10. The flame device as claimed in claim 9, wherein the first section of the single metallic meshed wick material includes a second chamfer extending from the head end to the other of the first and second lateral sides.

11. The flame device as claimed in claim 1, wherein the spiral section and portions of the wrapped sections which are wrapped around and have contours conforming with shapes of the spiral section define semi-opened chambers.

12. The flame device as claimed in claim 1, wherein the first and second imaginary planes are on opposite sides of the imaginary axis.

* * * * *